US009119259B2

(12) United States Patent
Tan et al.

(10) Patent No.: US 9,119,259 B2
(45) Date of Patent: Aug. 25, 2015

(54) AMOLED PIXEL UNIT DRIVING CIRCUIT AND METHOD, AMOLED PIXEL UNIT AND DISPLAY APPARATUS

(75) Inventors: Wen Tan, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 135 days.

(21) Appl. No.: 13/805,732

(22) PCT Filed: Aug. 23, 2012

(86) PCT No.: PCT/CN2012/080515

§ 371 (c)(1),
(2), (4) Date: Dec. 20, 2012

(87) PCT Pub. No.: WO2013/026404

PCT Pub. Date: Feb. 28, 2013

(65) Prior Publication Data

US 2013/0147386 A1 Jun. 13, 2013

(30) Foreign Application Priority Data

Aug. 25, 2011 (CN) ..... 2011 1 0247334

(51) Int. Cl.
*G09G 3/30* (2006.01)
*H05B 33/08* (2006.01)
*G09G 3/32* (2006.01)

(52) U.S. Cl.
CPC ..... *H05B 33/0842* (2013.01); *G09G 3/325* (2013.01)

(58) Field of Classification Search
CPC ..... H04B 37/00
USPC ..... 315/169.1, 167, 226; 345/76
See application file for complete search history.

(56) References Cited

U.S. PATENT DOCUMENTS 6,774,877 B2 * 8/2004 Nishitoba et al. ..... 345/76
6,859,193 B1 * 2/2005 Yumoto ..... 345/82

(Continued)

FOREIGN PATENT DOCUMENTS

CN 1312535 A 9/2001
CN 1497523 A 5/2004

(Continued)

OTHER PUBLICATIONS

International Search Repot; dated Aug. 25, 2011; PCT/CN2012/080515.

(Continued)

*Primary Examiner* — Douglas W Owens
*Assistant Examiner* — Wei Chan
(74) *Attorney, Agent, or Firm* — Ladas & Parry LLP

(57) ABSTRACT

The present disclosure discloses an AMOLED pixel unit driving circuit and method, an AMOLED pixel unit and a display apparatus, the AMOLED pixel unit driving circuit includes: a switching unit with a first input terminal connected to a current source for supplying a charging current and a second input terminal connected to an OLED; a storage capacitor with a first terminal connected to an output terminal of the switching unit and a second terminal connected to a low level; a driving TFT with a gate electrode connected to the first terminal of the storage capacitor and a source electrode connected to the low level; and a current dividing unit with a first terminal connected to the low level. The embodiments of the present disclosure enable a relatively large scale to exist between the charging current Idata and the current Ioled flowing through the OLED.

9 Claims, 3 Drawing Sheets

(56) References Cited

U.S. PATENT DOCUMENTS

| | | | | |
|---|---|---|---|---|
| 7,414,599 | B2 * | 8/2008 | Chung et al. | 345/76 |
| 7,773,054 | B2 * | 8/2010 | Jeong | 345/76 |
| 7,795,618 | B2 * | 9/2010 | Yamazaki et al. | 257/59 |
| 7,800,556 | B2 * | 9/2010 | Chen et al. | 345/76 |
| 7,800,564 | B2 * | 9/2010 | Numao | 345/82 |
| 8,049,684 | B2 * | 11/2011 | Kim | 345/76 |
| 8,482,491 | B2 * | 7/2013 | Kimura | 345/76 |
| 2001/0019327 | A1 | 9/2001 | Kim et al. | |
| 2003/0098829 | A1 | 5/2003 | Chen et al. | |
| 2003/0174152 | A1 * | 9/2003 | Noguchi | 345/690 |
| 2004/0056828 | A1 * | 3/2004 | Choi et al. | 345/82 |
| 2004/0113874 | A1 | 6/2004 | Kasai | |
| 2005/0200300 | A1 * | 9/2005 | Yumoto | 315/169.1 |
| 2006/0063298 | A1 * | 3/2006 | Winters | 438/99 |
| 2006/0139259 | A1 | 6/2006 | Choi et al. | |
| 2006/0220581 | A1 * | 10/2006 | Yamazaki et al. | 315/169.3 |
| 2006/0232521 | A1 * | 10/2006 | Jang et al. | 345/76 |
| 2006/0256046 | A1 * | 11/2006 | Kimura | 345/76 |
| 2006/0267509 | A1 * | 11/2006 | Yang | 315/169.3 |
| 2007/0296671 | A1 * | 12/2007 | Han et al. | 345/92 |
| 2008/0106208 | A1 * | 5/2008 | Choi et al. | 315/169.3 |
| 2008/0170053 | A1 * | 7/2008 | Chiou | 345/205 |
| 2008/0238327 | A1 * | 10/2008 | Cho et al. | 315/169.3 |
| 2010/0097360 | A1 | 4/2010 | Cho et al. | |
| 2011/0069099 | A1 * | 3/2011 | Sun | 345/698 |
| 2011/0234734 | A1 * | 9/2011 | Nagumo | 347/132 |
| 2012/0161637 | A1 * | 6/2012 | Lee et al. | 315/122 |
| 2013/0043796 | A1 * | 2/2013 | Ko et al. | 315/151 |
| 2013/0069537 | A1 * | 3/2013 | Sun et al. | 315/123 |

FOREIGN PATENT DOCUMENTS

| | | | |
|---|---|---|---|
| CN | 102708787 | A | 10/2012 |
| EP | 1 130 565 | A1 | 9/2001 |
| KR | 20070000831 | A | 1/2007 |
| TW | 529006 | B | 4/2003 |

OTHER PUBLICATIONS

International Preliminary Report on Patentability dated Feb. 25, 2014; PCT/CN2012/080515.

First Chinese Office Action dated Dec. 27, 2013; Appln. No. 201110247334.5.

Chinese Reexamination Notification dated Mar. 4, 2015; Appln. No. 201110247334.5.

* cited by examiner

AMOLED PIXEL UNIT DRIVING CIRCUIT AND METHOD, AMOLED PIXEL UNIT AND DISPLAY APPARATUS

TECHNICAL FIELD OF THE DISCLOSURE

The present disclosure relates to displaying and driving technique, and particularly to an Active Matrix Organic Light Emitting Diode (AMOLED) pixel unit driving circuit and method, an AMOLED pixel unit and a display apparatus.

BACKGROUND

AMOLED can emit light when it is driven by a current generated by a driving Thin Film Transistor (TFT) in a saturated state, that is, AMOLED is driven to emit light by the current. FIG. 1 is a principal diagram showing an existing basic AMOLED pixel structure of current type. As shown in FIG. 1, the existing basic AMOLED pixel structure of current type includes an OLED, T1, T2, T3, T4 and a storage capacitor Cst, wherein T1 is a driving Thin Film Transistor, T2, T3 and T4 are controlling Thin Film Transistors, and a gate electrode of T2 and a gate electrode of T3 are connected to a control line for outputting a control signal CN1, a gate electrode of T4 is connected to a control line for outputting a control signal CN2. In the existing basic AMOLED pixel structure of current type, a driving current Idata is directly applied from the external to determine a voltage across the storage capacitor Cst, and then a driving current Ioled is generated for driving an Organic Light-Emitting Diode (OLED) to emit light. In the existing basic AMOLED pixel structure of current type, Ioled is equal to Idata, and Ioled is a small current since it has to be in the range of the operating current of the OLED, and thus Idata is also a small current. The storage capacitor Cst usually has a large capacitance so that the speed for charging is relatively slower, and the time for charging is substantially long especially under a low gray level, which is not suitable for an AMOLED display with high resolution and high refreshing frequency.

SUMMARY

In view of the above, the present disclosure provides an AMOLED pixel unit driving circuit and method, an AMOLED pixel unit and a display apparatus, capable of enabling a large scale to exist between a charging current Idata and a current Ioled flowing through the OLED, so that Idata can be a relatively large current and Ioled is guaranteed to be in the range of the operating current of the OLED, and thus expediting the speed for charging the storage capacitor Cst.

According to a first aspect of the present disclosure, embodiments of the present disclosure provide an AMOLED pixel unit driving circuit for driving OLED, the AMOLED pixel unit driving circuit includes:

a switching unit with a first input terminal connected to a current source for supplying a charging current and a second input terminal connected to the OLED;

a storage capacitor with a first terminal connected to an output terminal of the switching unit and a second terminal connected to a low level;

a driving TFT with a gate electrode connected to the first terminal of the storage capacitor and a source electrode connected to the low level; and a current dividing unit with a first terminal connected to the low level, wherein the switching unit, during a first time period, switches on paths from the first input terminal to a drain electrode of the driving TFT and a second terminal of the current dividing unit so as to charge the storage capacitor by means of the current source, and switches off paths from the second input terminal to the drain electrode of the driving TFT and the second terminal of the current dividing unit; and the switching unit, during a second time period, switches on the path from the second input terminal to the drain electrode of the driving TFT, switches off the path from the second input terminal to the second terminal of the current dividing unit, and switches off the paths from the first input terminal to the drain electrode of the driving TFT and the second terminal of the current dividing unit.

In an embodiment, the current dividing unit is a current dividing TFT.

In an embodiment, the first terminal of the current dividing unit is a source electrode of the current dividing TFT, the second terminal of the current dividing unit is a drain electrode of the current dividing TFT, and a gate electrode of the current dividing TFT is connected to the first terminal of the storage capacitor.

In an embodiment, a threshold voltage of the driving TFT is equal to a threshold voltage of the current dividing TFT.

In an embodiment, the switching unit includes a third switching element, a fourth switching element, a fifth switching element an a sixth switching element, wherein the gate electrode of the driving TFT and the gate electrode of the current dividing TFT are connected to the current source via the third switching element;

the drain electrode of the driving TFT is connected to the current source via the fourth switching element;

the drain electrode of the driving TFT is connected to the OLED via the fifth switching element;

the drain electrode of the current dividing ITT is connected to the drain electrode of the driving TFT via the sixth switching element;

the third switching element switches on connection among the gate electrode of the driving TFT, the gate electrode of the current dividing TFT and the current source during the first time period, and switches off the connection among the gate electrode of the driving TFT, the gate electrode of the current dividing TFT and the current source during the second time period;

the fourth switching element switches on connection between the drain electrode of the driving TFT and the current source during the first time period, and switches off the connection between the drain electrode of the driving TFT and the current source during the second time period;

the fifth switching element switches on connection between the drain electrode of the driving TFT and the OLED during the second time period; and the sixth switching element switches on connection between the drain electrode of the current dividing TFT and the drain electrode of the driving TFT during the first time period, and switches off the connection between the drain electrode of the current dividing TFT and the drain electrode of the driving TFT during the second time period.

In an embodiment, the driving TFT, the current dividing TFT, the third switching element, the fourth switching element, the fifth switching element and the sixth switching element are n-type TFTs.

According to a second aspect of the present disclosure, embodiments of the present disclosure further provide an AMOLED pixel unit driving method based on the above-described AMOLED pixel unit driving circuit, and the AMOLED pixel unit driving method includes:

a step for charging pixel: switching on the paths from the current source for supplying the charging current to the drain electrode of the driving TFT and the second terminal of the current dividing unit, controlling the current source to charge the storage capacitor, and dividing the charging current supplied from the current source into two parts flowing through the driving TFT and the current dividing unit, respectively; and a step for driving an OLED to emit light for displaying: driving the OLED to emit light by means of the driving TFT.

According to a third aspect of the present disclosure, embodiments of the present disclosure further provide an AMOLED pixel unit including an OLED and the above-described AMOLED pixel unit driving circuit, the AMOLED pixel unit driving circuit is connected to a cathode of the OLED, and an anode of the OLED is connected to a power line for outputting a voltage VDD.

According to a fourth aspect of the present disclosure, embodiments of the present disclosure further provide a display apparatus including a plurality of AMOLED pixel units as described above.

Compared to the prior art, the AMOLED pixel unit driving circuit and method, the AMOLED pixel unit and the display apparatus provided in the embodiments of the present disclosure enable a relatively large scale to exist between the current Idata for charging the storage capacitor Cst and the current Ioled flowing through the OLED so that Idata can be a relatively large current and Ioled is guaranteed to be in the range of the operating current of the OLED, thus expediting the speed for charging the storage capacitor Cst.

DETAILED DESCRIPTION

Embodiments of the present disclosure provide an AMOLED pixel unit driving circuit for driving OLED, the AMOLED pixel unit driving circuit includes:

a switching unit with a first input terminal connected to a current source for supplying a charging current and a second input terminal connected to the OLED;

a storage capacitor with a first terminal connected to an output terminal of the switching unit and a second terminal connected to a low level;

a driving TFT with a gate electrode connected to a first terminal of a storage capacitor and a source electrode connected to the low level; and a current dividing unit with a first terminal connected to the low level, wherein the switching unit, during a first time period, switches on paths from the first input terminal thereof to a drain electrode of the driving TFT and a second terminal of the current dividing unit so as to charge the storage capacitor by means of the current source, and switches off paths from the second input terminal thereof to the drain electrode of the driving TFT and the second terminal of the current dividing unit; and the switching unit, during a second time period, further switches on the path from the second input terminal to the drain electrode of the driving TFT, switches off the path from the second input terminal to the second terminal of the current dividing unit, and switches off the paths from the first input terminal to the drain electrode of the driving TFT and the second terminal of the current dividing unit.

In an embodiment, the current dividing unit is a current dividing TFT.

In an embodiment, the first terminal of the current dividing unit is a source electrode of the current dividing TFT, the second terminal of the current dividing unit is a drain electrode of the current dividing TFT, and a gate electrode of the current dividing TFT is connected to the first terminal of the storage capacitor.

Figure 1:
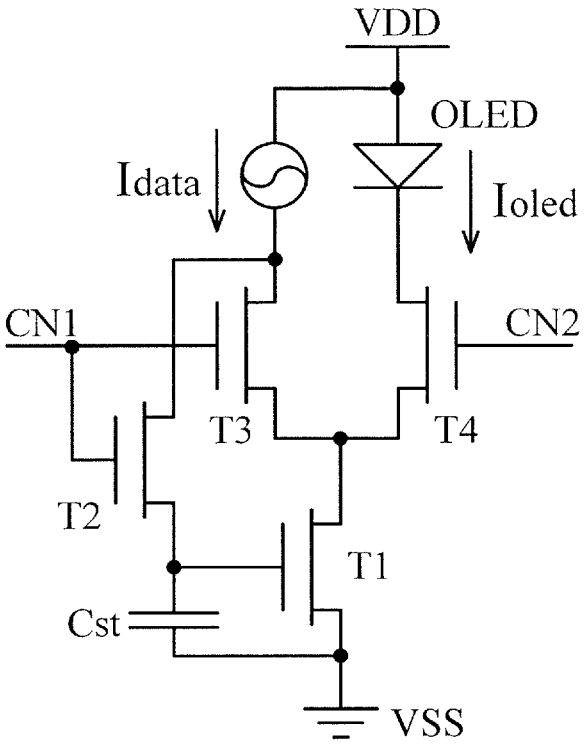
FIG. 1 is a principal diagram showing a existing basic AMOLED pixel structure of current type.
Figure 2:
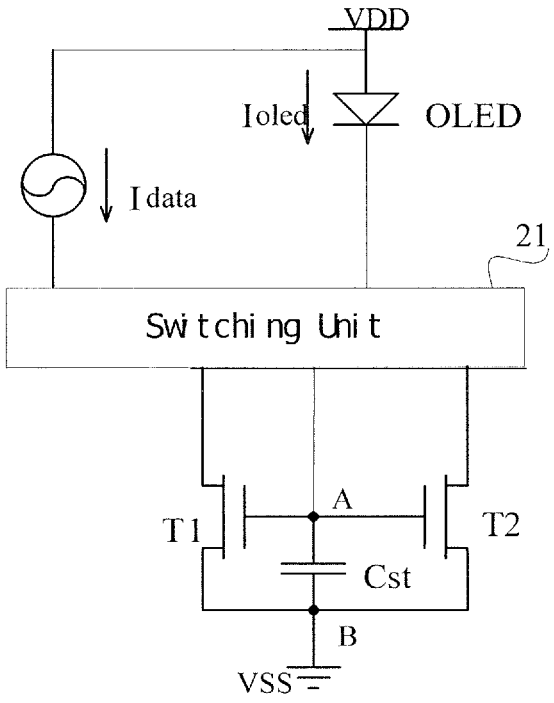
FIG. 2 is a circuit diagram showing a particular embodiment of an AMOLED pixel unit according to embodiments of the present disclosure.

As shown in FIG. 2, according to a particular implementation, embodiments of the present disclosure provide an AMOLED pixel unit driving circuit for driving OLED, the AMOLED pixel unit driving circuit includes:

a switching unit 21 with a first input terminal connected to a current source for supplying a charging current Idata and a second input terminal connected to the OLED;

a storage capacitor Cst with a first terminal connected to an output terminal of the switching unit 21 and a second terminal connected to a low level VSS; and a driving TFT T1 and a current dividing TFT T2, gate electrodes of both being connected to the first terminal of the storage capacitor Cst and source electrodes of both connected to the low level VSS;

wherein the switching unit 21, during a first time period, switches on paths from the first input terminal to a drain electrode of the driving TFT T1 and a drain electrode of the current dividing TFT T2 so as to charge the storage capacitor Cst by means of the current source, and switches off paths from the second input terminal to the drain electrode of the driving TFT T1 and the drain electrode of the current dividing TFT T2; and the switching unit 21, during a second time period, further switches on the path from the second input terminal to the drain electrode of the driving TFT T1, switches off the path from the second input terminal to the drain electrode of the current dividing TFT T2, and switches off the paths from the first input terminal to the drain electrode of the driving TFT T1 and the drain electrode of the current dividing TFT T2.

In an embodiment, a threshold voltage of the driving TFT T1 is equal to a threshold voltage of the current dividing TFT T2.

In an embodiment, the switching unit 21 includes a third switching element, a fourth switching element, a fifth switching element an a sixth switching element, wherein both the gate electrode of the driving TFT T1 and the gate electrode of the current dividing TFT T2 are connected to the current source via the third switching element;

the drain electrode of the driving TFT T1 is connected to the current source via the fourth switching element;

the drain electrode of the driving TFT T1 is connected to the OLED via the fifth switching element;

the drain electrode of the current dividing TFT T2 is connected to the drain electrode of the driving TFT T1 via the sixth switching element;

the third switching element switches on connection among the gate electrode of the driving TFT T1, the gate electrode of the current dividing TFT T2 and the current source during the first time period, and switches off the connection among the gate electrode of the driving TFT T1, the gate electrode of the current dividing TFT T2 and the current source during the second time period;

the fourth switching element switches on connection between the drain electrode of the driving TFT T1 and the current source during the first time period, and switches off the connection between the drain electrode of the driving TFT T1 and the current source during the second time period;

the fifth switching element switches on connection between the drain electrode of the driving TFT T1 and the OLED during the second time period; and the sixth switching element switches on connection between the drain electrode of the current dividing TFT T2 and the drain electrode of the driving TFT T1 during the first time period, and switches off the connection between the drain electrode of the current dividing TFT T2 and the drain electrode of the driving TFT T1 during the second time period.

In an embodiment, the driving TFT T1, the current dividing TFT T2, the third switching element, the fourth switching element, the fifth switching element and the sixth switching element are n-type TFTs.

Embodiments of the present disclosure further provide an AMOLED pixel unit driving method based on the above-described AMOLED pixel unit driving circuit, and the AMOLED pixel unit driving method includes:

a step of charging a pixel: switching on the paths from the current source for supplying the charging current to the drain electrode of the driving TFT and to the second terminal of the current dividing unit, controlling the current source to charge the storage capacitor and dividing the charging current supplied from the current source into two parts flowing through the driving TFT and the current dividing unit, respectively; and a step of driving the OLED to emit light for displaying: switching on the path from the second input terminal to the drain electrode of the driving TFT, and driving the OLED to emit light by means of the driving TFT.

Embodiments of the present disclosure further provide an AMOLED pixel unit including OLED and the above-described AMOLED pixel unit driving circuit, wherein the AMOLED pixel unit driving circuit is connected to a cathode of the OLED, and an anode of the OLED is connected to a power line for outputting a voltage VDD.

Embodiments of the present disclosure further provide a display apparatus including a plurality of AMOLED pixel units described above.

Figure 3:
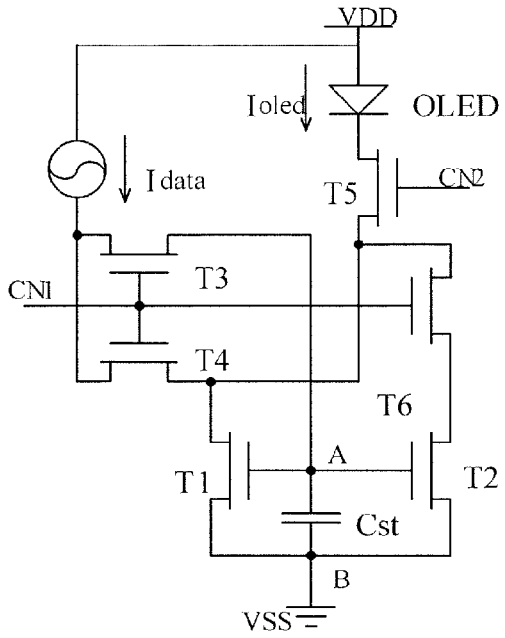
FIG. 3 is a circuit diagram showing another particular embodiment of an AMOLED pixel unit according to embodiments of the present disclosure.

FIG. 3 is a circuit diagram showing connection between OLED and a particular embodiment of the AMOLED pixel unit driving circuit according to embodiments of the present disclosure, that is, a circuit diagram showing a particular embodiment of the AMOLED pixel unit according to embodiments of the present disclosure. The AMOLED pixel unit driving circuit according to the embodiment adopts a 6T1C circuit and allows a relatively large scale to exist between the charging current Idata and the current Ioled flowing through the OLED in a manner of current dividing so that Idata can be a relatively large current and Ioled is guaranteed to be in the range of the operating current of the OLED, which solves the problem of a slow charging speed due to a small charging current in a traditional current type AMOLED pixel structure, thus expediting the speed for charging the storage capacitor Cst.

As shown in FIG. 3, T1, T2, T3, T4, 15 and T6 are all n-type TFTs, wherein T1 is a driving TFT, T2 is a current dividing TFT, T3, T4, T5 and T6 are control switching TFTs, Cst is a storage capacitor, and wherein a threshold voltage of T1 is equal to a threshold voltage of T2.

In FIG. 3, both a source electrode of T1 and a source electrode of T2 are connected to a second terminal of Cst and to a low level VSS;

both a gate electrode of T1 and a gate electrode of T2 are connected to a first terminal of Cst;

both the gate electrode of T1 and the gate electrode of T2 are connected to a current output terminal of a current source for supplying a charging current Idata via T3;

a drain electrode of T1 is connected to the current output terminal of the current source for providing the charging current Idata via T4;

a drain electrode of T2 is connected to the drain electrode of T1 via T6;

a cathode of OLED is connected to the drain electrode of T1 via T5, and an anode of OLED is connected to a power line for outputting a voltage VDD;

T3, T4 and T6 control the charging current Idata to charge the storage capacitor Cst during the charging stage, and T2 controls the dividing of the charging current Idata;

T5 controls a driving current to flow through the OLED to make the OLED emit light for displaying after the charging for the pixel is completed;

a gate electrode of T3, a gate electrode of T4 and a gate electrode of T6 are connected to a control signal CN1, both a drain electrode of T3 and a drain electrode of T4 are connected to the current output terminal of the current source for supplying the charging current Idata; and a gate electrode of T5 is connected to a control signal CN2.

Figure 4:
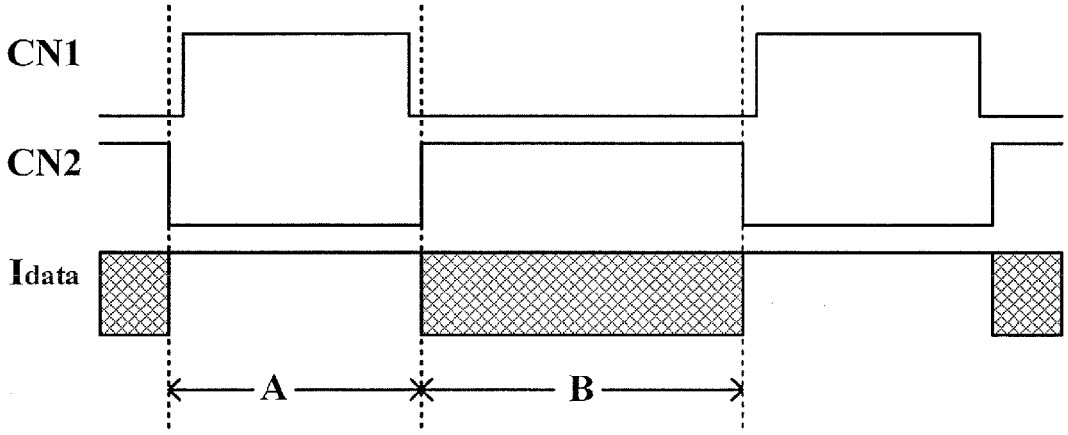
FIG. 4 is a timing sequence diagram showing a control signal CN1, a control signal CN2 and a charging current Idata.

FIG. 4 is a timing sequence diagram showing the control signal CN1, the control signal CN2 and the charging current Idata.

Figure 5:
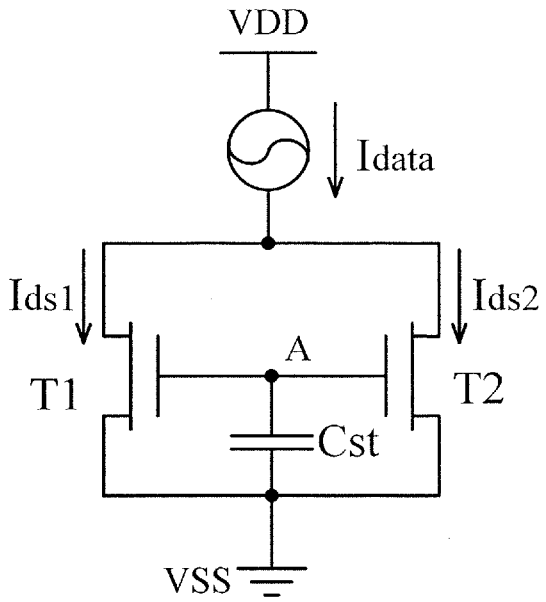
FIG. 5 is an equivalent circuit diagram of the particular embodiment of the AMOLED pixel unit according to embodiments of the present disclosure during a first time period.

As shown in FIG. 5, in the operation of the AMOLED pixel unit driving circuit according to the embodiment, during a first time period, that is, A stage, which is referred to as a pixel charging stage, CN1 is at a high level and CN2 is at a low level, T3, T4 and T6 are turned on, T5 is turned off, and thus both the drain electrode of T1 and the drain electrode of T2 are connected to the current output terminal of the current source for supplying the charging current Idata;

After being charged by the charging current Idata, a voltage difference value between the first terminal and the second terminal of the storage capacitor Cst becomes VA-VSS, T1 and T2 are in a saturation state at this time, and a current flowing through T1 is Ids1 and a current flowing through T2 is Ids2, Idata=Ids1+Ids2, and both the gate-source voltage Vgs of T1 and that of T2 are VA-VSS;

wherein $Ids1=\frac{1}{2}k1(Vgs-Vth)^2$;

$Ids2=\frac{1}{2}k2(Vgs-Vth)^2$;

$$\begin{aligned} Idata &= Ids1 + Ids2 \\ &= \frac{1}{2}k1(Vgs-Vth)^2 + \frac{1}{2}k2(Vgs-Vth)^2 \\ &= \frac{1}{2}(k1+k2)(Vgs-Vth)^2 \end{aligned}$$

so Ids1/Ids2=k1/k2, wherein T1 and T2 are n-type TFTs with different channel widths, k1 is a current coefficient of T1 and k2 is a current coefficient of T2;

$$k1 = \mu 1 \times C_{OX} \times \frac{W1}{L1};$$

$$k2 = \mu 2 \times C_{OX} \times \frac{W2}{L2};$$

wherein μ1, $C_{OX}$, W1 and L1 represent a field effect mobility, a gate insulating layer capacitance per unit area, a channel width and a channel length of T1, respectively, and μ2, $C_{OX}$, W2 and L2 represent a field effect mobility, a gate insulating layer capacitance per unit area, a channel width and a channel length of T2, respectively.

Figure 6:
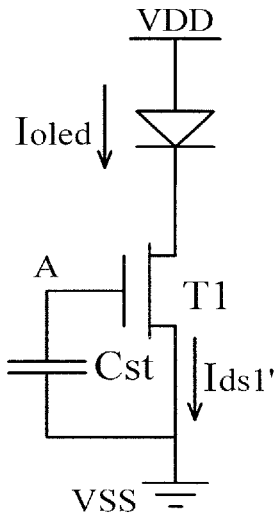
FIG. 6 is an equivalent circuit diagram of the particular embodiment of the AMOLED pixel unit according to embodiments of the present disclosure during a second time period.

As shown in FIG. 6, in the operation of the AMOLED pixel unit driving circuit according to the embodiment, during a second time period, that is, B stage, which is referred to as an OLED emitting light stage, CN2 is at a high level and CN1 is at a low level, T3, T4 and T6 are turned off, T5 is turned on, the voltage across the storage capacitor Cst is maintained to be Vgs, and thus T2 is turned off and T1 operates in a saturation region, the OLED is driven by a driving current Ioled to emit light for displaying;

at this time, a current flowing through the drain electrode of T1 is represented as Ids1'=½k1$(Vgs-Vth)^2$, and a current flowing through the drain electrode of T2 is represented as Ids2'=0;

Ioled refers to a current flowing through the OLED, and thus Ioled=Ids1'+Ids2'=½k1$(Vgs-Vth)^2$.

Therefore, the ratio of a current value of Idata to that of Ioled is equal to (k1+k2)/k1, and thus Ioled has a current value in proportion to that of Idata, and it enables a relatively large current scale to exist between Idata and Ioled so that Idata can be a relatively large current and Ioled is guaranteed to be in the range of the operating current of the OLED, thus expediting the speed for charging the storage capacitor Cst.

The above descriptions are only for illustrating the embodiments of the present disclosure, and in no way limit the scope of the present disclosure. The embodiment of the disclosure being thus described, it will be obvious that the same may be varied in many ways. Such variations are not to be regarded as a departure from the spirit and scope of the disclosure, and all such modifications as would be obvious to those skilled in the art are intended to be included within the scope of the following claims.

What is claimed is:

1. An AMOLED pixel unit driving circuit for driving an OLED, the AMOLED pixel unit driving circuit including:

a switching unit with a first input terminal connected to a current source for supplying a charging current and a second input terminal connected to the OLED;

a storage capacitor with a first terminal connected to an output terminal of the switching unit and a second terminal connected to a low level;

a driving TFT(Thin Film Transistor) with a gate electrode connected to the first terminal of the storage capacitor and a source electrode connected to the low level; and a current dividing TFT with a gate electrode connected to the gate electrode of the driving TFT and a source electrode connected to the low level, wherein the switching unit, during a first time period, switches on paths from the first input terminal to a drain electrode of the driving TFT and a drain electrode of the current dividing TFT so as to charge the storage capacitor by means of the current source, and switches off paths from the second input terminal to the drain electrode of the driving TFT and the drain electrode of the current dividing TFT; and the switching unit, during a second time period, switches on the path from the second input terminal to the drain electrode of the driving TFT, switches off the path from the second input terminal to the drain electrode of the current dividing TFT, and switches off the paths from the first input terminal to the drain electrode of the driving TFT and the drain electrode of the current dividing TFT.

2. The AMOLED pixel unit driving circuit of claim 1, wherein a threshold voltage of the driving TFT is equal to a threshold voltage of the current dividing TFT.

3. The AMOLED pixel unit driving circuit of claim 1, wherein the switching unit includes a third switching element, a fourth switching element, a fifth switching element and an a sixth switching element, wherein the gate electrode of the driving TFT and the gate electrode of the current dividing TFT are connected to the current source via the third switching element;

the drain electrode of the driving TFT is connected to the current source via the fourth switching element;

the drain electrode of the driving TFT is connected to the OLED via the fifth switching element;

the drain electrode of the current dividing TFT is connected to the drain electrode of the driving TFT via the sixth switching element;

the third switching element switches on connection among the gate electrode of the driving TFT, the gate electrode of the current dividing TFT and the current source during the first time period, and switches off the connection among the gate electrode of the driving TFT, the gate electrode of the current dividing TFT and the current source during the second time period;

the fourth switching element switches on connection between the drain electrode of the driving TFT and the current source during the first time period, and switches off the connection between the drain electrode of the driving TFT and the current source during the second time period;

the fifth switching element switches on connection between the drain electrode of the driving TFT and the OLED during the second time period; and the sixth switching element switches on connection between the drain electrode of the current dividing TFT and the drain electrode of the driving TFT during the first time period, and switches off the connection between the drain electrode of the current dividing TFT and the drain electrode of the driving TFT during the second time period.

4. The AMOLED pixel unit driving circuit of claim 3, wherein the driving TFT, the current dividing TFT, the third switching element, the fourth switching element, the fifth switching element and the sixth switching element are n-type TFTs.

5. An AMOLED pixel unit driving method applied to the AMOLED pixel unit driving circuit of claim 1, and the AMOLED pixel unit driving method including:

a step for charging the pixel; switching on the paths from the current source for supplying the charging current to the drain electrode of the driving TFT and the drain electrode of the current dividing TFT, controlling the current source to charge the storage capacitor, and dividing the charging current supplied from the current source into two parts flowing through the driving TFT and the current dividing TFT, respectively; and a step for driving the OLED to emit light for displaying: switching on the path from the second input terminal to the drain electrode of the driving TFT, and driving the OLED to emit light for displaying by means of the driving TFT.

6. An AMOLED pixel unit including an OLED and the AMOLED pixel unit driving circuit of claim 1, the AMOLED pixel unit driving circuit is connected to a cathode of the OLED, and an anode of the OLED is connected to a power line for outputting a voltage VDD.

7. The AMOLED pixel unit of claim 6, wherein a threshold voltage of the driving TFT is equal to a threshold voltage of the current dividing TFT.

8. The AMOLED pixel unit of claim 6, wherein the switching unit includes a third switching element, a fourth switching element, a fifth switching element an a sixth switching element, wherein the gate electrode of the driving TFT and the gate electrode of the current dividing TFT are connected to the current source via the third switching element;

the drain electrode of the driving TFT is connected to the current source via the fourth switching element;

the drain electrode of the driving TFT is connected to the OLED via the fifth switching element;

the drain electrode of the current dividing TFT is connected to the drain electrode of the driving TFT via the sixth switching element;

the third switching element switches on connection among the gate electrode of the driving TFT, the gate electrode of the current dividing TFT and the current source during the first time period, and switches off the connection among the gate electrode of the driving TFT, the gate electrode of the current dividing TFT and the current source during the second time period;

the fourth switching element switches on connection between the drain electrode of the driving TFT and the current source during the first time period, and switches off the connection between the drain electrode of the driving TFT and the current source during the second time period;

the fifth switching element switches on connection between the drain electrode of the driving TFT and the OLED during the second time period; and the sixth switching element switches on connection between the drain electrode of the current dividing TFT and the drain electrode of the driving TFT during the first time period, and switches off the connection between the drain electrode of the current dividing TFT and the drain electrode of the driving TFT during the second time period.

9. The AMOLED pixel unit of claim 8, wherein the driving TFT, the current dividing TFT, the third switching element, the fourth switching element, the fifth switching element and the sixth switching element are n-type TFTs.

* * * * *